United States Patent [19]

Dwinell

[11] Patent Number: 4,520,942

[45] Date of Patent: Jun. 4, 1985

[54] CONTAINER CLOSURE HAVING A FRANGIBLE OUTER CAP

[75] Inventor: Davis B. Dwinell, Warren, N.J.

[73] Assignee: American Flange & Manufacturing Co. Inc., Linden, N.J.

[21] Appl. No.: 602,481

[22] Filed: Apr. 20, 1984

[51] Int. Cl.[3] ..... B65D 51/20

[52] U.S. Cl. ..... 220/257; 215/251; 215/306

[58] Field of Search ..... 220/257, 270, 306; 215/251

[56] References Cited

U.S. PATENT DOCUMENTS

| | | | |
|---|---|---|---|
| 2,760,671 | 8/1956 | Parish, Jr. | 220/257 |
| 3,131,827 | 5/1964 | Wheaton | 220/257 |
| 3,158,282 | 11/1964 | Housz | 220/257 |
| 3,223,279 | 12/1965 | Wheaton | 220/306 |
| 3,425,471 | 2/1969 | Yates, Jr. | 220/306 |
| 3,717,276 | 2/1973 | Luczak et al. | 220/257 |

FOREIGN PATENT DOCUMENTS 455944 3/1950 Italy .

*Primary Examiner*—George T. Hall

[57] ABSTRACT

A two piece closure assembly consisting of a metal tamperproof overcap and a plastic recloseable undercap. The metal overcap has a recessed center panel surrounded by a downwardly opening sealing channel. The plastic undercap has a similar configuration but with a slightly narrower sealing channel so as to loosely nest within the overcap in assembled position. The overcap is further provided with a diametrically extending tear strip defined by a pair of parallel score lines. A gripping ear extends from each end of the tear strip at the sealing channel outer edge. The gripping ears besides providing ready access for tearing and removal of the overcap intact are configured to hold the overseal and undercap in assembled position for application as a unit to a container opening.

8 Claims, 8 Drawing Figures

CONTAINER CLOSURE HAVING A FRANGIBLE OUTER CAP

BACKGROUND OF THE INVENTION

In the packaging of fluid products in commercial size container such as five gallon pails, a need has arisen for a fast pouring, tamperproof closure possessing a high degree of sealing efficiency on molded plastic containers. One such prior art closure consists of a threaded plug with a separate tamperproof overseal. This arrangement while satisfying to some degree the functional requirements, is at the same time seriously lacking in cost effectiveness. Not only are the separate plug and overseal components relatively costly items, in addition, molding the internally threaded container neck is expensive as is the application of the two separate closure components after the container if filled.

Also failing to meet the basic functional requirements has been the use of well known nestable spout type closures. While such pouring spout closures are easily crimped onto a simple opening neck, they cannot offer the quick emptying capacity desired. These closure arrangements only encourage the end user to, in one way or another, destroy the closure to achieve faster pouring, a practice fraught with hazard.

Frequently lacking in the prior art crimped on closure arrangements is the degree of sealing integrity needed to meet current packaging regulations. This deficiency becomes particularly apparent over the wide range of dimensional and surface variations encountered on mass produced plastic container openings. Adequate sealing strength to overcome these variations under extreme performance conditions is not always supplied by the prior art crimped on closures.

SUMMARY OF THE INVENTION

This invention is directed to a reusable tear off closure assembly for containers.

The above prior art deficiencies are effectively overcome by the invention in providing a two piece closure assembly which is crimped onto an upstanding neck formed about a container opening so as to create a rigid, high strength barrier against leakage. Moreover, once the closure is removed, a maximum opening area is advantageously exposed for fast, convenient pouring.

The invention closure consists of a preassembled metal tamperproof overcap and a plastic recloseble undercap. Both caps are formed with a recessed center panel surrounded by a downwardly opening sealing channel so as to nest together as a unit prior to the crimping operation. As the cap is crimped, the neck is tightly squeezed within the sealing channel with a metal overcap center panel supplying strength and rigidity across the plane of the opening with a gripping ear at either end to enable removal of the overcap intact separate from the underlying plastic cap. The plastic undercap which serves as a resuable friction fit snap cap is then easily removed exposing the entire opening, clean and untouched for fast, full flow dispensing.

It is accordingly a principal object of the invention to provide a new and improved recloseable tamperproof closure for large volume plastic containers.

Another object is to provide a new compact two piece closure assembly capable of withstanding severe handling and shipping abuse without loss of seal integrity.

A further object is to provide a new, large capacity, fast pouring which can be easily, completely removed from the container to expose a maximum opening area.

Other and more detailed objects will in part be obvious and in part pointed out as the description of the invention taken in conjunction with the accompanying drawing proceeds. In that drawing.

Figure 1:
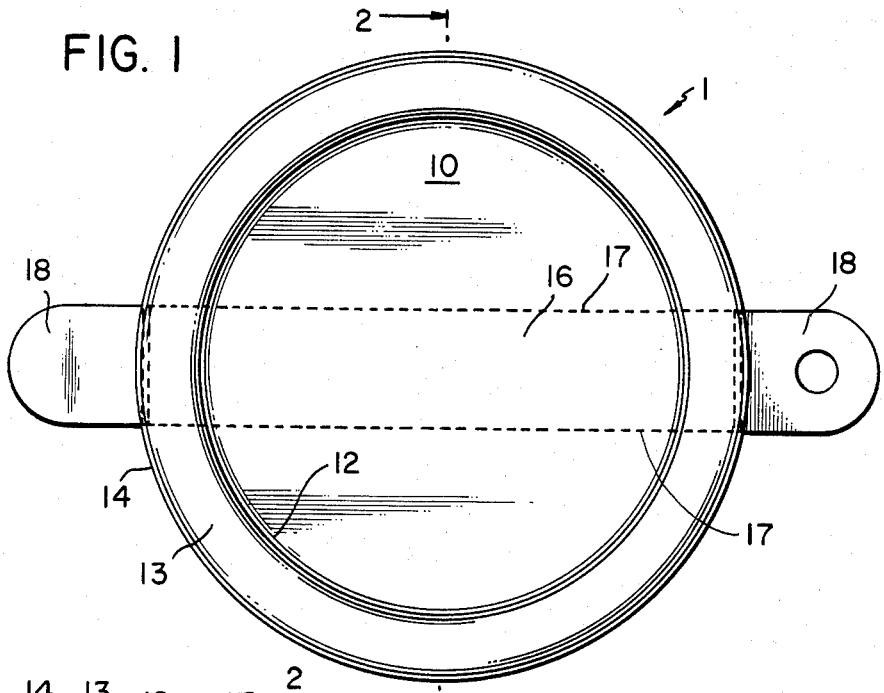
FIG. 1 is a top plan view of the container closure in accordance with the invention.
Figure 2:
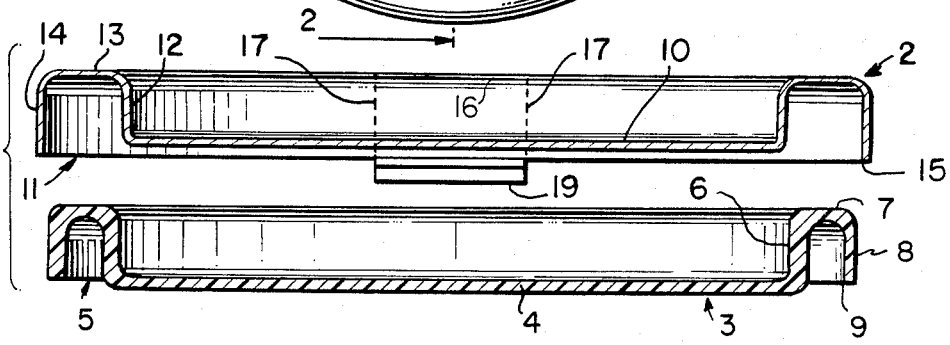
FIG. 2 is an exploded sectional view showing the elements of the closure assembly.

The closure 1 of the invention consists of a two piece assembly made up of a metal overcap 2 and a plastic undercap 3. The undercap has a recessed center panel 4 surrounded by a downwardly opening sealing channel 5. The sealing channel has an inner wall 6 extending upwardly substantially vertically from the center panel 4, an annular top wall 7 and a substantially vertical depending outer wall 8. The outer wall 8 has substantially the same length as the inner wall 6 and terminates in a free edge 9.

Figure 3:
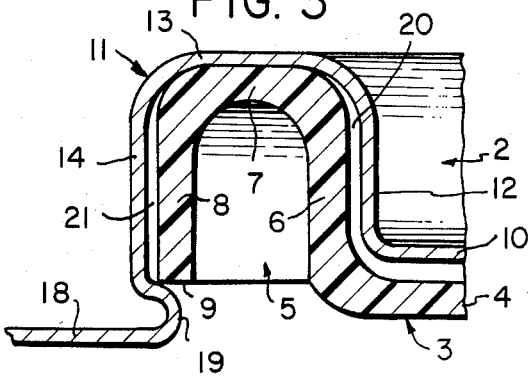
FIG. 3 is an enlarged fragmentary sectional view of the assembled closure showing the configuration of the gripping ear.

The metal outercap 2 also has a recessed center panel 10 surrounded by a downwardly opening sealing channel 11. The sealing channel 11 has an inner wall 12 extending substantially vertically upwardly from the center panel 10, an annular top wall 13 and a substantially vertical depending outer wall 14 which terminates in a lowermost substantially free edge 15. A diametrically extending tear strip 16 is formed in the overcap 2 defined by a pair of parallel weakened score lines 17 which traverse the entire overcap including the recessed center panel 10 and opposing portions of the sealing channel 11. At either extremity of the tear strip 16 is a gripping ear 18 extending away from the outer wall free edge 15. With particular reference to FIG. 3 it can be seen that each ear 18, adjacent the edge 15, curves radially inwardly at 19 so as to partially obstruct the sealing channel 11 and then extends radially outwardly.

Considering the assembled closure again as particularly shown in FIG. 3, it can be seen that the complimentary configuration of the outercap 2 and the undercap 3 permit the undercap to loosely nest within the outercap. This assembled relationship is such that while the respective sealing channel top walls 7 and 13 may lie in close contact, a concentric spacing is provided between the respective inner and outer sidewalls of the nested sealing channels 5 and 11. That is to say, when the overcap 2 and undercap 3 are concentrically positioned, an annular **12*a* is created between the respective sealing channel inner walls 6 and 12 and a gap 14*a* between the outer walls 8 and 14. In addition, the inwardly deformed or curved ear portions 19 act as retainers for holding the plastic undercap nested within the metal overcap. The resilient nature of the plastic channel outer wall 8** allows the two caps to be easily urged into a nested position and assembled as a unit prior to being applied to a container wall opening.

Figure 4:
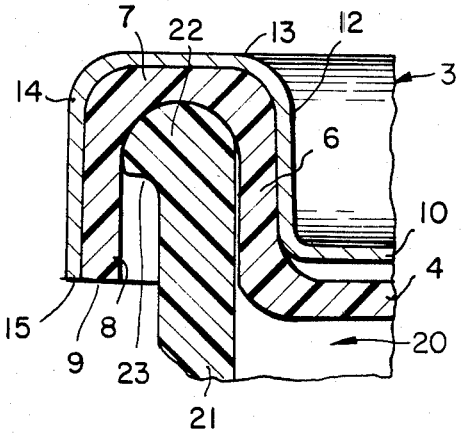
FIG. 4 is an enlarged fragmentary sectional view of the closure seated on a container opening neck.

The assembled closure 1 is shown in FIG. 4 seated on a plastic container opening prior to the final crimping or sealing operation. Such containers 20 uniformly include an upstanding neck 21, a circumferentially enlarged sealing bead 22 and a radially undercut locking surface 23. These containers, however, usually manufactured by the blow molding process, are not precisely uniform in their opening dimensions. These inherent production variations must be accomodated in the closure construction and it is for this reason that the annular gaps 12*a* and 14*a* are provided. These gaps allow the plastic undercap sealing channel walls 6 and 8 to flex in a radial direction within the confines of the relatively rigid overlying metal sealing channel 11. Depending on such variations as inner and outer opening diameters, bead cross section, ovality and the like, this flexure simply closes gap 12*a* and 14*a* as seen in FIG. 4 permitting the closure to properly seat on the opening with minimal vertical resistance prior to the crimping operation.

Figure 5:
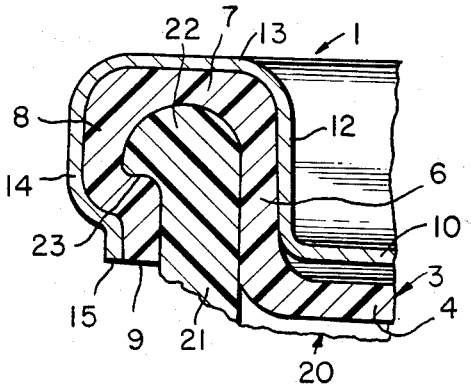
FIG. 5 is similar to FIG. 4 but showing the closure in crimped position.

The filled container 20 is then sealed for shipping by crimping the assembled closure 1 onto the bead 22. As seen in FIG. 5, this operation deforms the lower portion of the overcap outer wall 14 radially inwardly squeezing the undercap outer wall 8 tightly against the undercut locking surface 23. Once again inherent imperfections in the opening surfaces of molded plastic containers such as minute sink or flash at the cavity parting lines must be accommodated. In this regard it has been found that maximum sealing efficiency occurs when substantial compressive forces are radially applied to both exterior and interior surfaces of the bead 22. To achieve this condition, the inner wall 12 of the overcap sealing channel extends vertically downwardly a sufficient distance to completely reinforce the inner surface of the bead 22 in an annular zone where the radial crimping force is applied. In addition, the rigid center panel 10 further reinforces the wall 12 where most effective across the plane of the opening and in substantial horizontal alignment with the outer wall extremities 9 and 15. The result is a tight encasing of the opening bead 22 within the closure sealing channel which remains closely intact under the severe conditions imposed by current packaging regulations.

Figure 6:
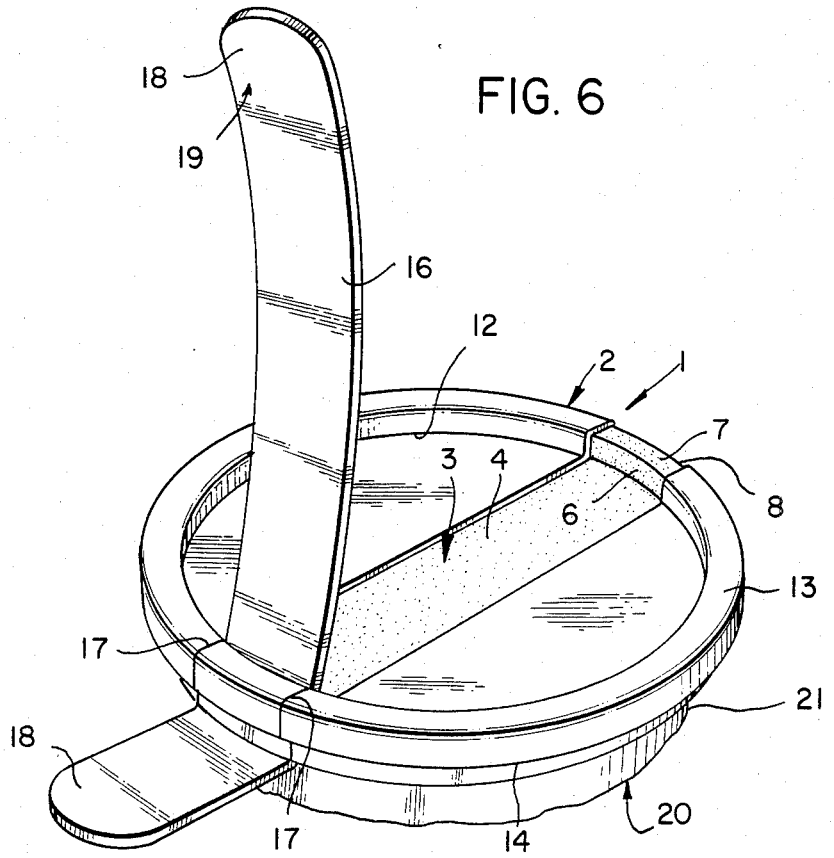
FIG. 6 is a prespective view of the closure on a container and in partially opened position.

Removal of the closure 1, as seen in FIG. 6, is accomplished by gripping either ear 18 and pulling radially outwardly and then upwardly in an arc over the opening. This motion causes the tear strip 16 to separate from the metal overcap 2 along the score lines 17, crossing first the adjacent sealing channel portion and then the recessed center panel 10. Upon reaching the wall 12 at the diametrically opposing sealing channel portion, by the above described continuous motion, tearing will be stopped. This occurs due to the relative difficulty in tearing metal folded back on itself and pulling in a direction substantially parallel to the line of tear. At this point the torn overcap can be readily pulled off of the container in one piece leaving the plastic undercap 3 still in place on the opening and thus avoiding the possibility of dirt or foreign matter entering the container during the opening operation. Access to the container is then easily gained by pulling the plastic undercap 3 off the opening leaving a clean, uncontaminated, previously sealed surface to pour over. Rapid fast flow dispensing ensues with even very viscous fluids through the full exposed opening.

Figure 7:
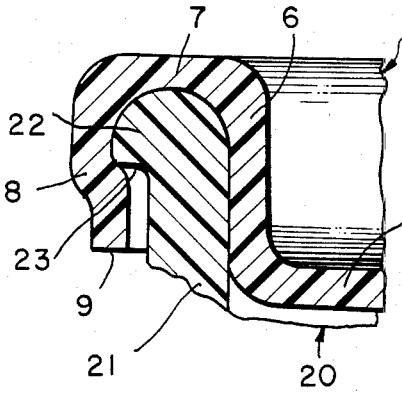
FIG. 7 is a view similar to FIG. 5 but with the metal overseal removed.

In those instances where it may be desirable to reclose the container for storage or carrying purposes, the undercap 3 acts as an effective snap cap for resiliently re-engaging the opening bead 22. This is partly attributable to the original snug friction fit of the closure on the opening and in part due to an advantageous cold flow deformation of the plastic cap caused over a period of time by the previous crimping operation. More specifically, as seen in FIG. 7, once the metal overseal is removed, the inwardly deformed lower portion of the plastic outer wall 8 only partially returns towards its original shape. This circumferential constriction remains for quite some period of time and has been found to further enhance the use of the undercap as a reclosing device.

Figure 8:
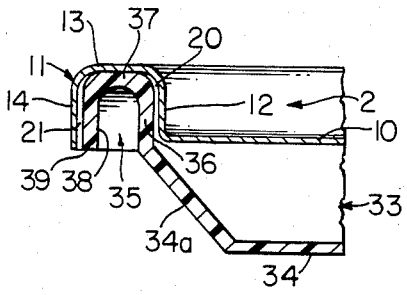
FIG. 8 is a fragmentary sectional view showing a modified form of undercap.

FIG. 8 shows a closure employing the same metal overcap 2 as shown in the principal embodiment but with a modified undercap 33 having a downwardly opening sealing channel 35 made up of an outer wall 38, a top wall 37 and an inner wall 36. The undercap center portion extends downwardly and radially inwardly in a conical sidewall 34*a* joining flat bottom wall 34. This undercap configuration provides a pilot to guide the closure onto a container opening to aid the capping operation.

Various other changes in or modifications of the closure and different embodiments of the invention would suggest themselves to those skilled in the art and could be made without departing from the spirit or scope of the invention. It is accordingly intended that all material contained in the above description or shown in the accompanying drawing shall be interpreted as being illustrative and not in a limiting sense.

I claim:

1. A two piece tamper-evident closure assembly comprising a metal tear-off overcap and a plastic reusable undercap, said undercap including a recessed center panel surrounded by a downwardly opening sealing channel said sealing channel having an inner wall extending upwardly substantially vertically from said center panel, an annular top wall and a depending substantially vertical outer wall terminating in a lower free edge, said inner wall and said outer wall being substantially equal in vertical length, said overcap having a complimentary configuration so as to closely confine said undercap, a diametrically extending tear strip formed in said overcap commencing in an outwardly projecting gripping ear, said tear strip defined by a pair of score lines commencing at either side of said ear and extending across said cap wherein removal of said overcap is achieved by pulling said ear first radially outwardly so as to tear across the contiguous outer wall portion then pulling upwardly and radially inwardly causing said tearing to continue across said center panel and terminate at the remote sealing channel inner wall.

2. A closure assembly as in claim 1 including an ear disposed at either end of said tear strip.

3. A closure assembly as in claim 1 including retaining means for holding said undercap and overcap in assembled relationship.

4. A closure assembly as in claim 1 wherein removal of the metal overcap leaves the outer wall of said undercap sealing channel circumferentially constricted to aid said reuse.

5. A closure assembly as in claim 1 and said center panel including depending pilot means to center said closure in a container opening.

6. A two piece tamper-evident closure assembly comprising a metal tear-off overcap and a plastic reusable undercap, said overcap including a recessed center panel surrounded by a downwardly opening sealing channel said sealing channel having an inner wall extending upwardly substantially vertically from said center panel, an annular top wall and a depending substantially vertical outer wall terminating in a lower free edge, a diametrically extending tear strip formed in said overcap commencing at said free edge in an outwardly projecting gripping ear, said tear strip defined by a pair of score lines commencing at either side of said ear and extending across said cap, said undercap having a complimentary configuration so as to nest within said overcap and providing an annular spacing between the adjacent vertical walls of said overcap and undercap wherein said undercap can expand within said overcap to accommodate container opening dimensional variations.

7. A two piece tamper-evident closure assembly for plastic containers comprising a metal tear-off overcap and a plastic reusable undercap, said overcap including a recessed center panel surrounded by a downwardly opening sealing channel said sealing channel having an inner wall extending upwardly substantially vertically from said center panel, an annular top wall and a depending substantially vertical outer wall terminating in a lower free edge, said undercap having a complimentary configuration so as to nest within said overcap, a diametrically extending tear strip defined by a pair of score lines formed in said overcap commencing at said free edge in opposed outwardly projecting gripping ears and means formed in conjunction with said ears for retaining said overcap and undercap in nested assembled position.

8. A closure assembly as in claim 5 wherein said retaining means consists of a radially inward deformation of said ears.

* * * * *